US005832606A

United States Patent [19]

Kushner

[11] Patent Number: 5,832,606

[45] Date of Patent: Nov. 10, 1998

[54] METHOD FOR PREVENTING ONE-CELL STALL IN BLADED DISCS

[75] Inventor: Francis Kushner, Delmont, Pa.

[73] Assignee: Elliott Turbomachinery Co., Inc., Jeannette, Pa.

[21] Appl. No.: 931,559

[22] Filed: Sep. 16, 1997

Related U.S. Application Data

[60] Provisional application No. 60/026,211 Sep. 17, 1996.

[51] Int. Cl.[6] ..... B23D 15/00

[52] U.S. Cl. ..... 29/889.7; 29/407.08

[58] Field of Search ..... 415/1, 13; 29/889.7, 29/404, 407.08

[56] References Cited

U.S. PATENT DOCUMENTS

| | | | |
|---|---|---|---|
| 2,767,906 | 10/1956 | Doyle | 230/134 |
| 3,006,603 | 10/1961 | Caruso et al. | 253/39 |
| 3,639,080 | 2/1972 | Yamabe | 416/186 |
| 3,973,872 | 8/1976 | Seleznev et al. | 415/211 |
| 4,265,593 | 5/1981 | Hatton et al. | 416/183 |
| 4,401,410 | 8/1983 | Nishikawa | 416/186 R |
| 4,538,963 | 9/1985 | Sugio et al. | 416/203 |
| 4,666,373 | 5/1987 | Sugiura | 416/185 |
| 4,900,228 | 2/1990 | Yapp | 416/183 |
| 4,971,516 | 11/1990 | Lawless et al. | 415/1 |
| 5,000,660 | 3/1991 | Van Houten et al. | 416/203 |
| 5,002,461 | 3/1991 | Young et al. | 416/183 |
| 5,011,371 | 4/1991 | Gottemoller | 415/211.1 |
| 5,026,251 | 6/1991 | Kinoshita et al. | 415/119 |
| 5,310,309 | 5/1994 | Terasaki et al. | 415/208.3 |
| 5,328,333 | 7/1994 | Quinn | 416/193 R |
| 5,508,943 | 4/1996 | Batson et al. | 415/1 |

OTHER PUBLICATIONS

Van Den Braembussche, R., "Surge and Stall in Centrifugal Compressors", VKI Lecture Series 1984–07–Flow in Centrifugal Compressors, von Karman Institute for fluid Dynamics, Rhode Saint Genese, Belgium (May 1984) (89 pages).

Fringe, P. and Van Den Braembussche, R., "Distinction Between Different Types of Impeller and Diffuser Rotating Stall in a Centrifugal Compressor with Vaneless Diffuser", ASME Journal of Engineering for Gas Turbines and Power, 106, pp. 468–474 (April 1984).

*Primary Examiner*—I. Cuda

*Attorney, Agent, or Firm*—Webb Ziesenheim Bruening Logsdon Orkin & Hanson, P.C.

[57] ABSTRACT

A method for preventing one-cell rotating stall initiated by a bladed disc having a plurality of blades including the steps of identifying a one-cell stall condition and modifying one or more blades to force the bladed disc into at least a two-cell stall pattern. This can be accomplished by modifying the spacing between the blades to force the bladed disc into at least a two-cell stall pattern. Alternatively, at least one of the blades can be geometrically modified so as to force the bladed disc into at least a two-cell stall pattern.

8 Claims, 9 Drawing Sheets

METHOD FOR PREVENTING ONE-CELL STALL IN BLADED DISCS

CROSS REFERENCE TO RELATED APPLICATION

This application claims the benefit of U.S. Provisional patent application Ser. No. 60/026,211, filed Sep. 17, 1996.

BACKGROUND OF THE INVENTION

1) Field of the Invention

This invention relates generally to bladed discs used in centrifugal and axial gas compressors, and more particularly, to a method for preventing one-cell rotating stall in the bladed discs used in these compressors.

2) Description of the Prior Art

Industrial axial gas compressors and centrifugal gas compressors have many applications, such as compressing natural gas for transport. These compressors can be expensive, costing hundreds of thousands if not millions of dollars. Axial gas compressors and centrifugal gas compressors typically have one rotor with impellers or bladed discs. FIG. 1 shows a bladed disc 10 that includes a disc 12 having a plurality of blades 14 secured thereto. The rotating blades 14 have a unique design to maximize efficiency. Operating conditions, as well as the size and type of compressor, determines the specific blade shape and the number of blades provided on the disc 12 and, if required, stationary entry vanes and exit vanes can be used for the design.

Optimum operation of the compressor requires exacting tolerances of the blades 14 and their spacing around the disc 12. In theory, all of the blades 14 should be identically shaped and equally spaced around the disc 12. This arrangement will result in a dynamically balanced bladed disc. However, in practice, the blade geometries vary in any given impeller and in many cases, the spacing between adjacent blades also varies. These variations can cause differences in rotating stall characteristics.

Rotating stall is a phenomenon that occurs in compressors due to unsteady gas flow about the bladed disc under low flow, high pressure conditions. Generally, stall will initially occur adjacent to or at one or more blades. Referring to FIG. 2, initially, a localized stall 16 develops adjacent one or more blades 18. This localized stall will have a frequency which is the same as the frequency of the rotor. Gradually, the stall 16 will increase in size and propagate in the circumferential direction "c". The stall 16 then travels to different blades at a frequency less than the frequency of the rotor. Depending on the number of blades initially experiencing stall, one or more rotating stall cells can form, as shown in FIGS. 3A and 3B.

A one-cell stall pattern initiated by a bladed disc, as shown in FIG. 3A, includes a low pressure zone 24 and a high pressure zone 26 formed in the area 20 about the circumference of the bladed disc. Zones 24 and 26 have a circumferential speed $\omega_s$, which is a fraction of the impeller or rotor speed $\omega_r$. Relative to each rotating blade, the zones 24 and 26 travel backwards at a speed of $\omega_r-\omega_s$ where adjacent blades will experience additional stall. This creates a rotating high pressure zone (+) and low pressure zone (−) or a rotating pressure field about the bladed disc 12, which in turn results in a net fluctuating force "F" on the rotor at a frequency "P" as shown in FIG. 4. FIG. 4 identifies relative blade change in pressures between 80 PSI and 100 PSI. Also, upstream and downstream localized unbalanced forces are applied to the rotor.

A multiple-cell stall, such as a two-cell stall, as shown in FIG. 3B, results in a balanced system whereby the sum of the forces created by the pressure zones 24 and 26 cancel each other out and have no effect on the rotor and the bearing system (not shown). Although localized forces are still present, an unbalanced rotating force "F" caused by the one-cell system is eliminated by multiple cells.

FIG. 5 shows a standard head/discharge pressure verses flow rate curve for a typical centrifugal compressor. In many instances, a phenomenon called surge occurs near or after the peak or apex of the curve. Surge occurs at a high operating discharge pressure and a low flow rate condition. Surge causes pressure waves to pass through the compressor and the attached piping and can damage the compressor. This is especially true if surge occurs over extended periods of time. Typically, a pressure/flow rate curve is generated for every axial compressor and centrifugal compressor. The curve can be analytically generated, empirically generated or generated by test data on the manufacturer's test floor or in the field after the compressor has been installed.

Typically, surge protection devices are incorporated with centrifugal compressors and axial compressors. The surge protector, which is well known in the art, prevents the compressor from operating at the surge point, a low flow high pressure condition. Referring to FIG. 5, a first point "$A_0$" on the pressure/flow rate curve is determined under a high flow rate condition. Then, the discharge pressure of the compressor is measured for incrementally lower flow rates so that additional points "$A_1$", "$A_2$", "$A_3$", "$A_4$", "$A_5$", "$A_6$" and "$A_7$" are determined. It is known in the art that rotating stall can occur at a higher flow rate than surge, if rotating stall occurs at all. Hence, by this method, the rotating stall point can be reached prior to the surge point.

As stated previously, one-cell rotating stall results in an unbalanced load applied to the bladed disc (impeller) at a frequency that is less than the rotating frequency of the bladed disc. In many cases, continued operation at this frequency can cause the bearings, bearing seals and the rotor shaft which support the bladed disc to fail. Failure is due to stress, rubbing wear and/or fatigue. This rotating unbalanced load does not occur in compressors having more than one-cell rotating stall because the localized forces are evenly distributed about the rotor resulting in a balanced dynamic load. In extreme circumstances of one-cell rotating stall, the surge point cannot be determined due to the vibrations caused by the rotating force "F". Furthermore, the compressor may not be operated near the point where the one-cell rotating stall occurs. This limits the useful range and operation of the compressor since the surge protection device must be activated at an operating pressure where the one-cell rotating stall occurs as opposed to where the surge occurs. If the surge protection device fails, then damage could still occur to the system. Alternatively, the bladed disc can be replaced with design modifications in hopes that a one-cell rotating stall is not present in the replacement disc. This is a costly endeavor, which may not be successful.

Therefore, it is an object of the present invention to provide a method for determining and eliminating one-cell rotating stall in axial gas compressors and centrifugal gas compressors that is initiated within the rotating element.

SUMMARY OF THE INVENTION

The present invention is a method of preventing rotating stall of a bladed disc that includes the steps of identifying a one-cell stall condition and modifying one or more blades to force the bladed disc into at least a two-cell or more stall pattern. This can be accomplished by modifying the spacing of the blades or the geometric configuration of the blades. Preferably, a plurality of blades are modified in a sinusoidal relationship.

DESCRIPTION OF THE PREFERRED EMBODIMENTS

Figure 6:
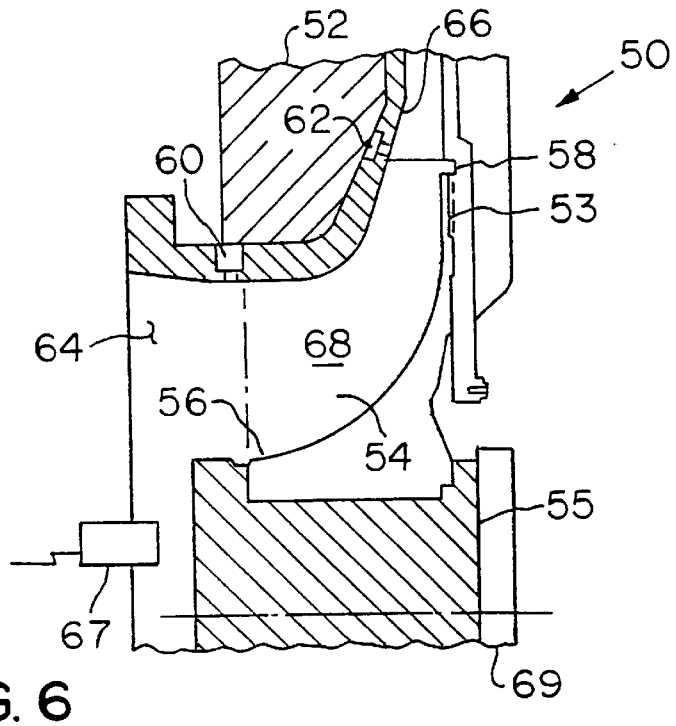
FIG. 6 is a partial, cross-sectional and schematic view of a portion of an impeller having a bladed disc as shown in FIG. 1.
Figure 7:
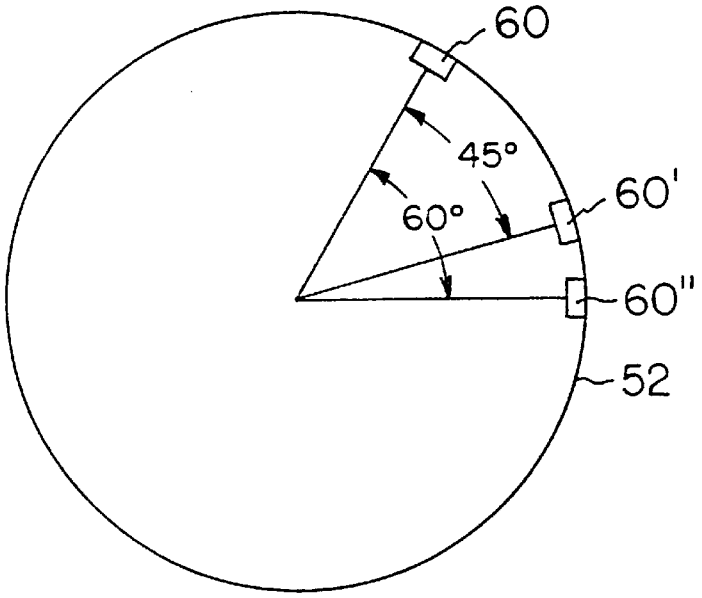
FIG. 7 is an end view representative of the placement of dynamic pressure probes in a compressor.
Figure 8:
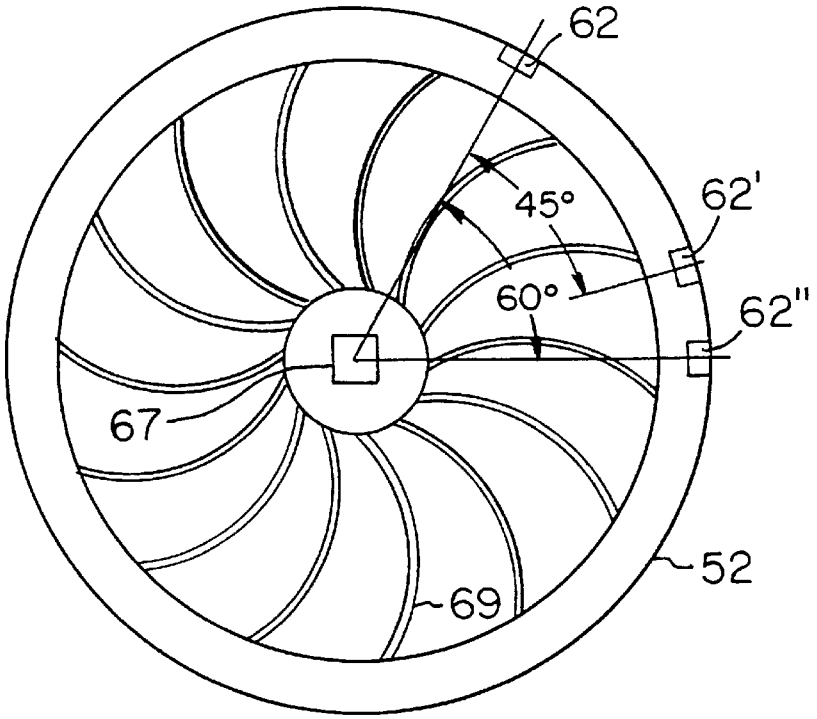
FIG. 8 is an end view showing a position of other dynamic pressure probes positioned in a compressor casing.
Figure 9:
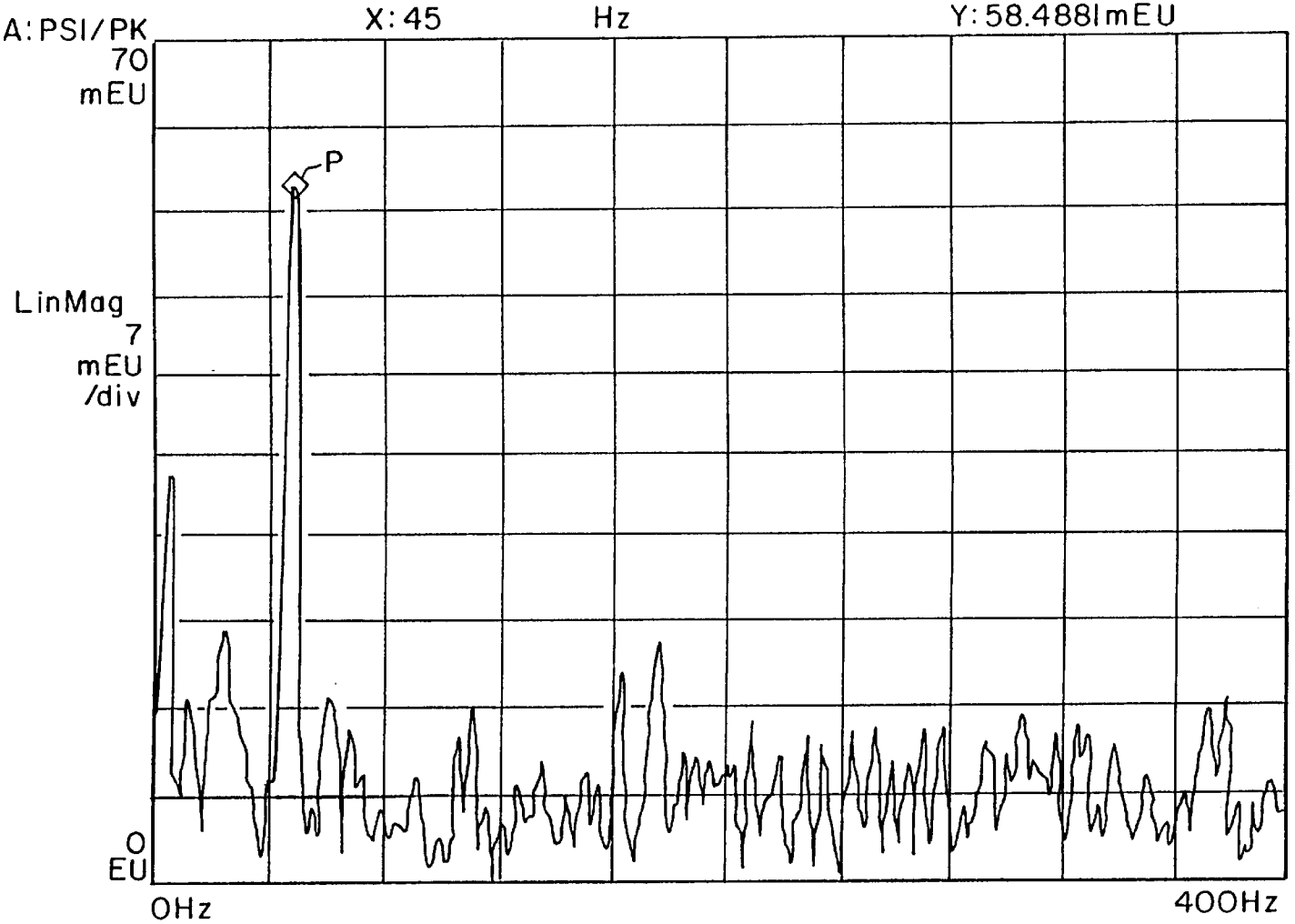
FIG. 9 is a graphic representation showing a pressure peak indicative of a one-cell rotating stall in a bladed disc.

FIG. 6 shows a partial cross section of a portion of a centrifugal compressor having a casing 52 and an impeller 53 that includes a plurality of blades 54 (only one of which is shown) secured to a disc 55. Each blade 54 includes a leading edge 56 and a trailing edge 58. Dynamic pressure probes 60, 60' and 60", and 62, 62' and 62", as shown in FIGS. 6–8, are secured to the casing 52 and are positioned at the entrance 64 and the exit 66 of an impeller containing chamber 68. Probes 60, 60' and 60" and 62, 62' and 62" measure localized changes in pressure at the casing walls. One type of probe is a flush mounted AC coupled transducer with 0.5 Hz to >10 KHz frequency response, two microsecond rise time, 100 mv/psi sensitivity and a high signal to noise ratio. Probes 60 and 60' are spaced 45° apart and probes 60 and 60" are spaced 60° apart, as shown in FIG. 7. Likewise, probes 62 and 62' are spaced 45° apart and probes 62 and 62" are spaced 60° apart, as shown in FIG. 8. An eddy current radial vibration sensor 67 is positioned adjacent the rotor 69. The probes 60, 60' and 60" and the eddy current radial vibration sensor 67 are coupled to a multi-channel F.F.T. (fast Fourier transfer analyzer) and are used to identify the presence of one-cell stall. FIG. 9 shows a dynamic reading from one of the probes 60 over the entire operating range of the compressor to encompass several harmonics, for example, from 0 Hz to 400 Hz. This information was plotted from information provided to the F.F.T.

Figure 1:
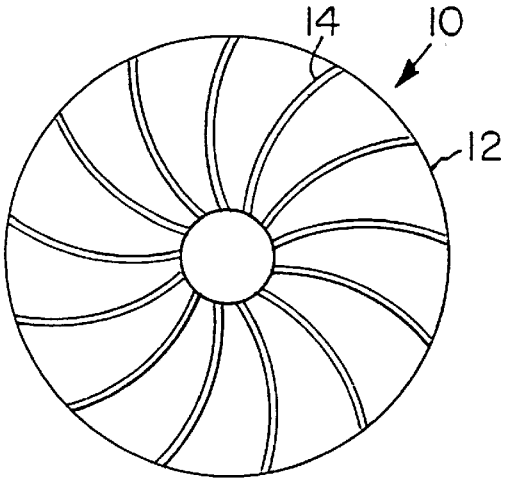
FIG. 1 is an end view of a bladed disc.
Figure 2:
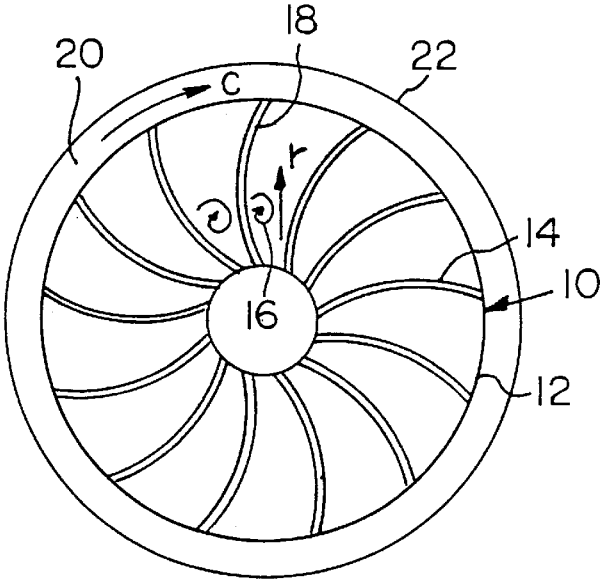
FIG. 2 is an end view of the bladed disc shown in FIG. 1 in a casing.
Figure 3A:
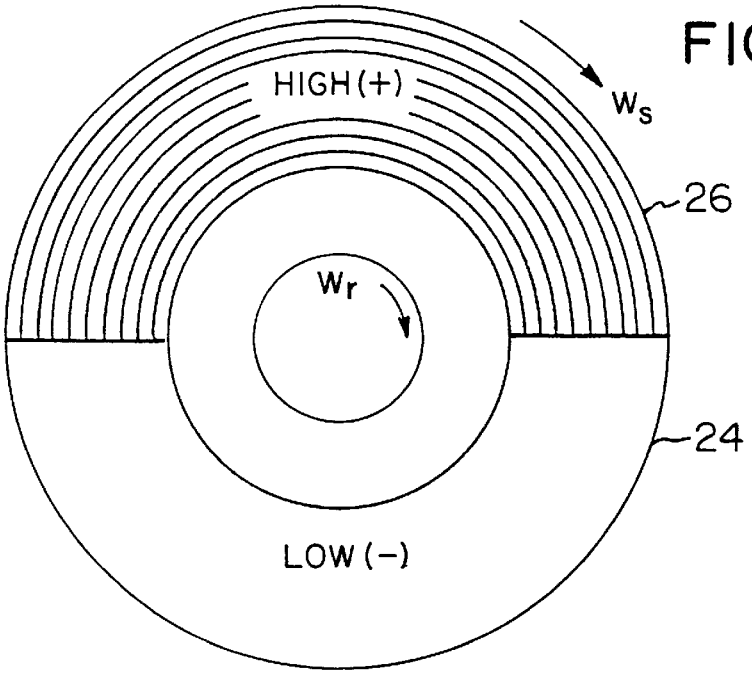
FIG. 3A is a schematic view of the bladed disc shown in FIG. 1 in a one-cell rotating stall pattern.
Figure 3B:
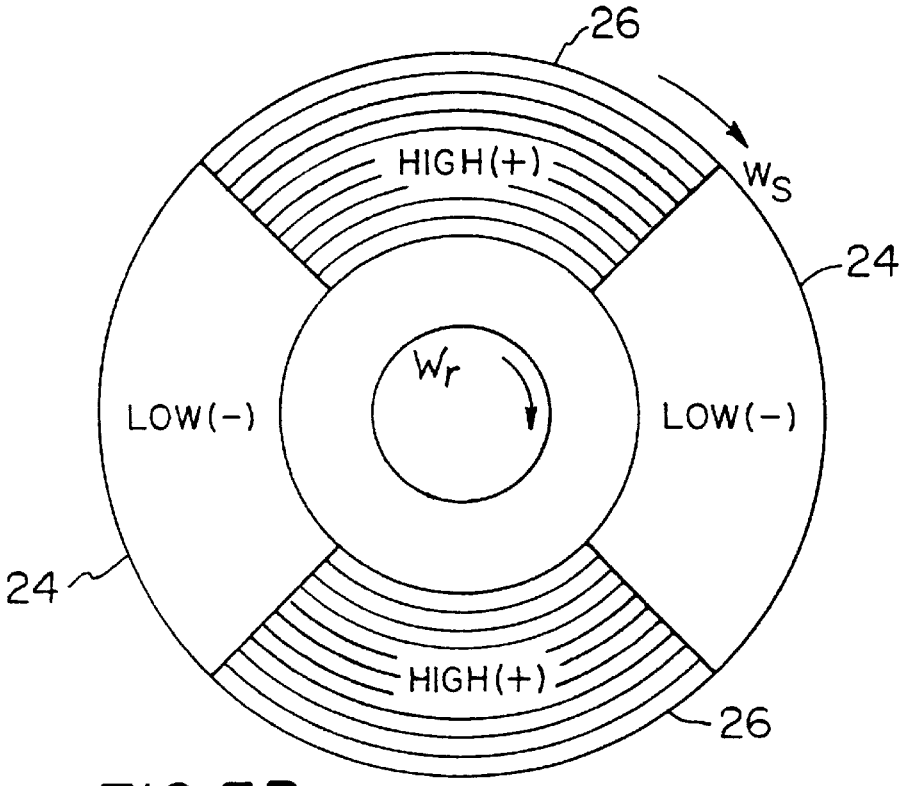
FIG. 3B is a schematic view of the bladed disc shown in FIG. 1 in a two-cell stall pattern.
Figure 4:
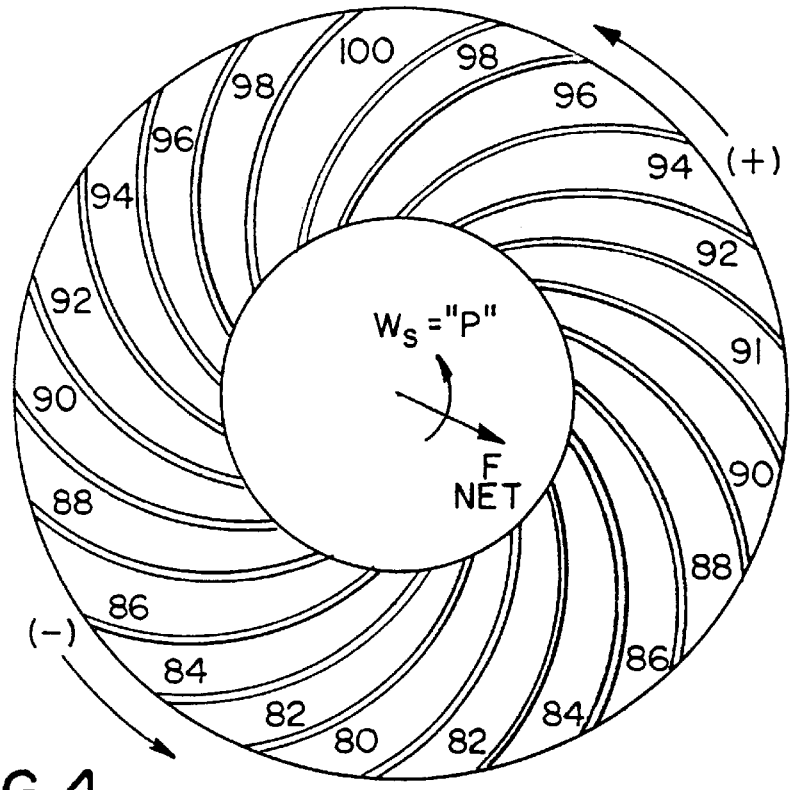
FIG. 4 is a schematic end view of a rotating pressure field in a one-cell stall pattern for a bladed disc similar to that shown in FIG. 1.
Figure 5:
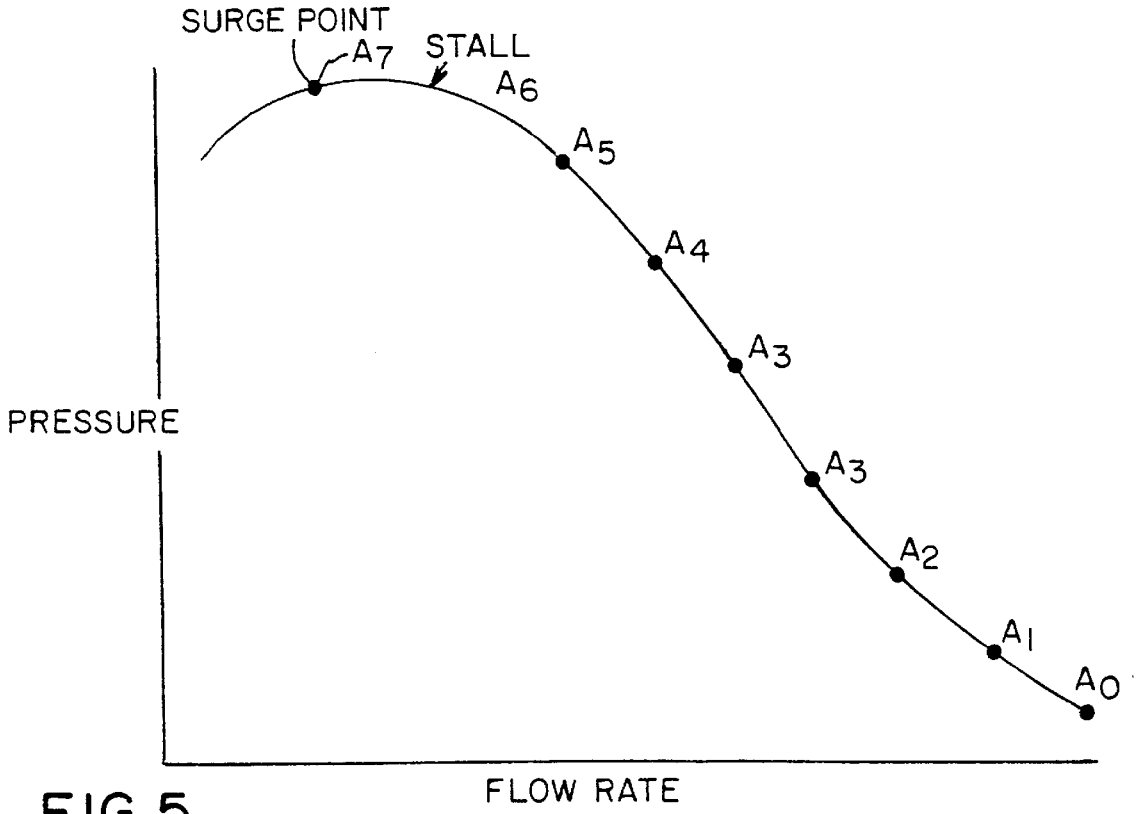
FIG. 5 is a pressure/flow rate curve for a compressor having a bladed disc shown in FIG. 1.

Similar readings are taken from the other probes 60' and 60", as well as from probes 62, 62' and 62". As can be seen in FIG. 9, a pressure peak at frequency "P" is identified. This pressure peak is indicative of stall in that stall only occurred as testing of the system approached point "$A_7$", as shown in FIG. 5. However, similar information must be reviewed from the other probes 60' and 60", as well as probes 62, 62' and 62", to determine whether a one-cell condition or a multiple-cell condition is present. This is determined by the phase angles between the probes and is well known in the art. The following equation is used to determine the phase angle between the probes.

$$\phi_s = n\,(\phi_m \pm \alpha) \pm \beta$$

where $\phi_s$=measured phase angle between stall cells in degrees n=number of rotating cells $\phi_m$=installed angles between two of the stationary probes 60, 60', 60", 62, 62', 62" in degrees $\alpha$=a tolerance on the installed angle between the probes and degrees $\beta$=tolerance in phase angle measurement in degrees Below is a chart showing the relative relationship between the separation and stall cells using the above equation, with $\alpha$ and $\beta$ equal to zero.

TABLE I

| Probe Separation (degrees) | Measured Phase Angle (degrees) | Implied Number of Cells |
|---|---|---|
| 180 | 180 | 1, 3, 5, 7, . . . |
| | 360 | 2, 4, 6, 8, . . . |
| 90 | 90 | 1, 5, 9, . . . |
| | 180 | 2, 6, 10, . . . |
| | 270 | 3, 7, 11, . . . |
| | 360 | 4, 8, 12, . . . |
| 60 | [60] | [1], 7, . . . |
| | 120 | 2, 8, . . . |
| | 180 | 3, 9, . . . |
| | 240 | 4, 10, . . . |
| | 300 | 5, 11, . . . |
| | 360 | 6, 12, . . . |
| 45 | [45] | [1], 9, . . . |
| | 90 | 2, 10, . . . |
| | 135 | 3, 11, . . . |
| | 180 | 4, 12, . . . |
| | 225 | 5, 13, . . . |
| | 270 | 6, 14, . . . |
| | 315 | 7, 15, . . . |
| | 360 | 8, 16, . . . |

Figure 10:
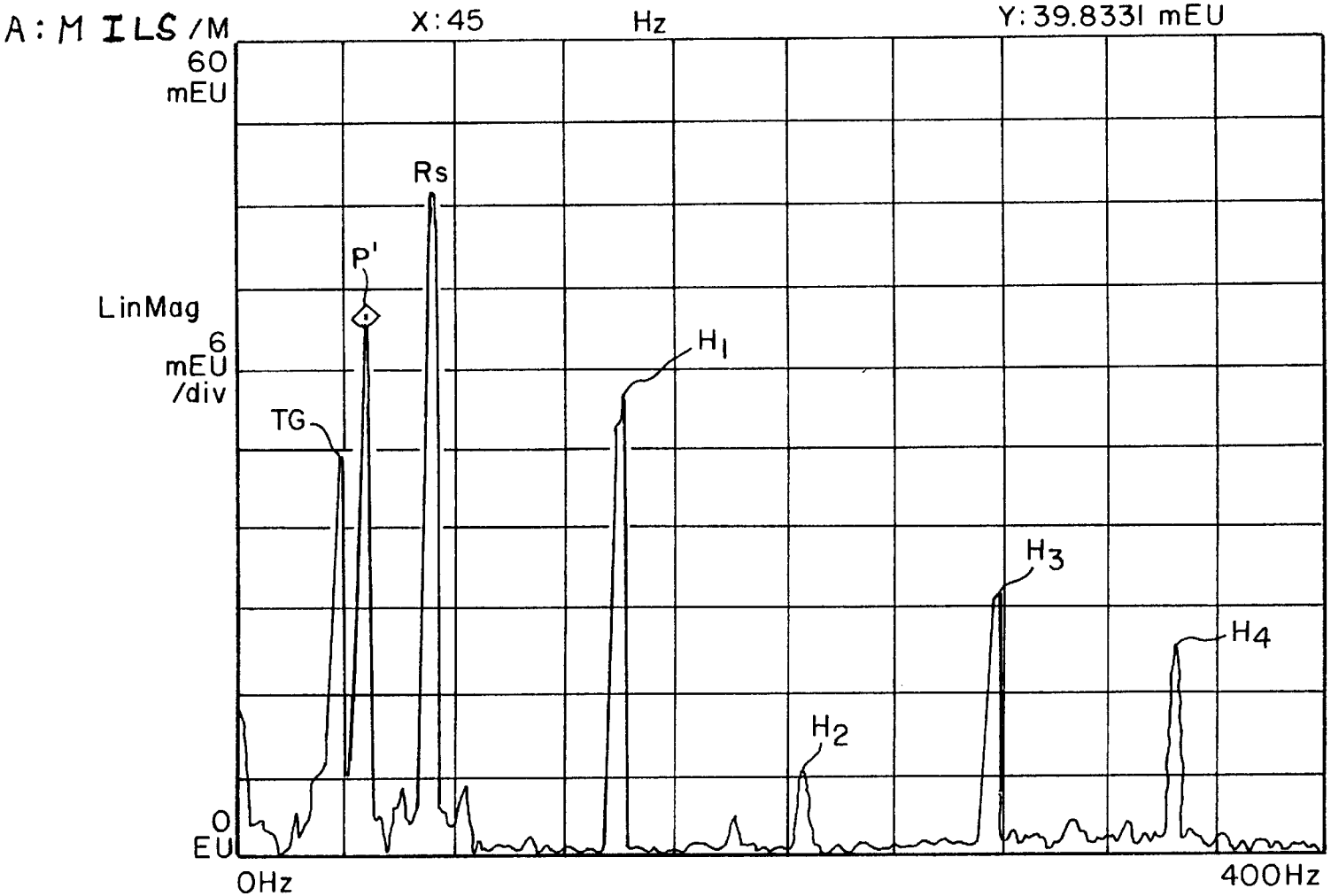
FIG. 10 is a graphic representation showing vibration of a bladed disc rotor corresponding to the bladed disc referred to in FIG. 9 and is indicative of a one-cell rotating stall pattern.

As can be seen, if a measured phase angle between the sensors is both 45° and 60°, a one-cell rotating stall condition exists. This can be verified by using the reading of the eddy current radial vibration sensor (see FIG. 10) that indicates high vibration of the rotor or impeller at frequency "P'". Frequency "P'" is below the operating speed of the rotor, which is shown as point "R.S." in FIG. 10. In the chart shown in FIG. 10, various other peaks are present, which are indicative of other rotating parts of the compressor, such as the turbine gear frequency "TG" and various harmonics "$H_1$", "$H_2$", "$H_3$" and "$H_4$" present in the compressor or due to shaft, electrical or mechanical run out. Hence, the use of the eddy current radial vibration sensor and the dynamic pressure probes confirm that a one-cell rotating stall condition exists since "P'" is equal to "P".

Once a one-cell rotating stall condition is identified, corrective measures can be taken to overcome this condition. First, the overall dimensions of the bladed disc can be measured using a coordinate measuring machine (C.M.M.) to determine where any non-symmetries occur on the bladed disc. Such non-symmetries can be due to either the blade dimensions or the spacing between the blades.

In some cases, dynamic pressure probe data may be used to indicate what part of the impeller is responsible for initiating rotating stall when the dynamic pressure probe is used in connection with a one pulse per revolution reference probe on the rotor.

Figure 11:
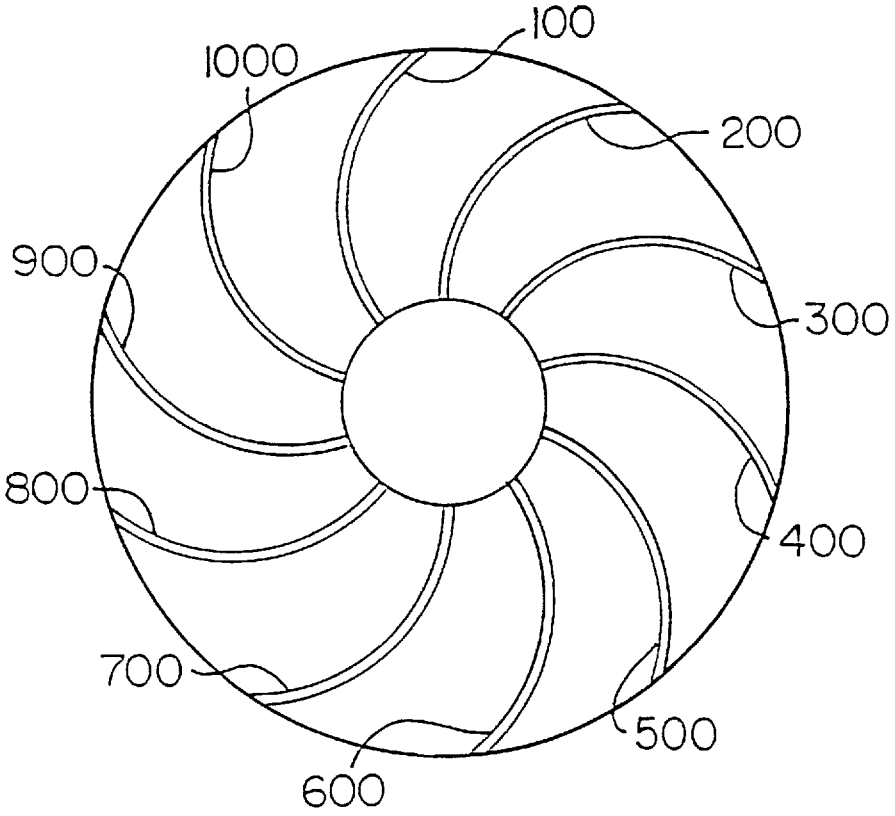
FIG. 11 is an end view of a bladed disc having ten blades.

Corrective procedures can now be taken to convert the one-cell condition into a multi-cell condition. If an even number of blades are present and only one blade has a different shape or spacing, the blade which is diametrically opposed to the differing blade can be modified to have the same geometric shape or spacing. As shown in FIG. 11, a bladed disc is provided having ten blades 100–1000. If blade 100 is geometrically different than the remaining blades 200–1000, it is assumed that blade 100 causes the one-cell stall pattern. To correct this condition, blade 600 is modified to have the same geometric shape as blade 100. This will create a two-cell rotating stall pattern, which will eliminate the rotating force "F". For an even number of blades divisible by four, blades 90° apart could be chosen to force a four cell pattern. Alternatively, all of the blades can be modified to form a sinusoidal pattern having two or more cyclical periods. In this manner, the sinusoidal pattern between the blades will help create a multiple-cell stall because rotating stall pressure and flow variations are typically nearly sinusoidal.

In the case of an odd number of blades, the blades can be modified to create multiple cells. For example, a twenty-one bladed disc can be modified so that the bladed disc includes three similar sections of seven blades, wherein the seven blades contained within each of the sections vary sinusoidally relative to each other. This will create a three-cell stall. A twenty-five bladed disc can be modified so that the bladed disc includes five similar sections of five blades, wherein the five blades contained within each of the sections vary sinusoidally relative to each other. In the first case, the variations of the blades will result in three periods and the variation of the twenty-five bladed disc will result in five periods. In the case where the bladed disc has a prime number of blades, say nineteen, then a sinusoidal relationship could be determined to modify all of the blades to create a multiple-cell stall. Other choices for odd number of blades would be to use only two blades nearly opposite each other or three blades as close as possible to 120° apart. This can be optional using Fourier analysis.

In cases where the exact dimensions of the blade cannot be measured or the cause of the rotating stall cannot be identified, a multiple-cell stall pattern can be forced on the system to overcome the one-cell stall pattern.

Figure 12:
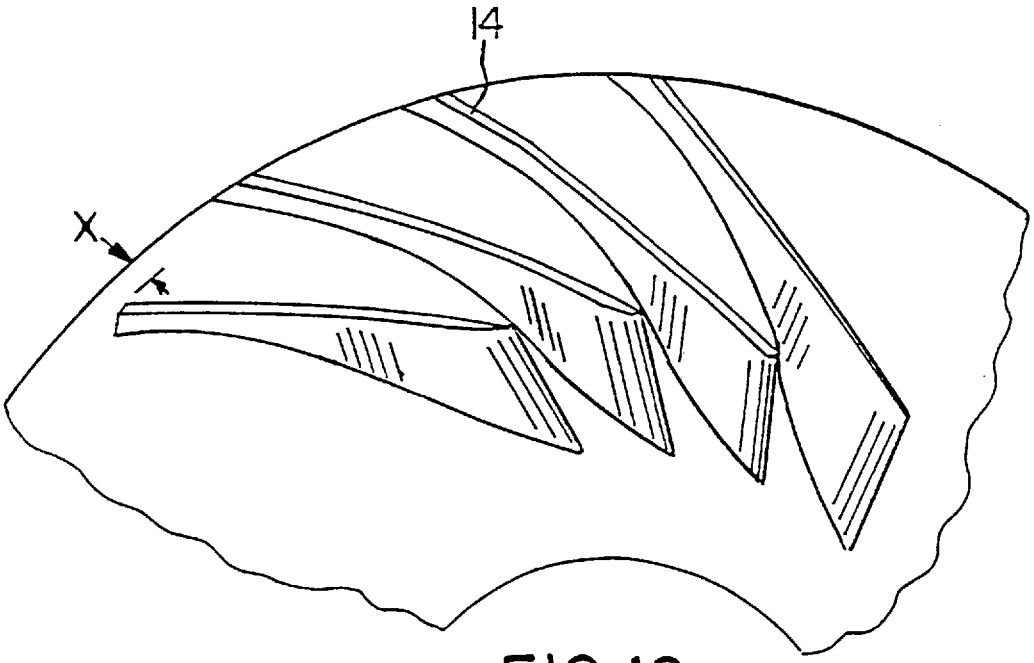
FIG. 12 is an end view of a portion of a bladed disc.

For example, in a twenty-one bladed disc for a mid flow covered impeller, as shown in FIG. 12, a one-cell rotating stall condition was found to exist. Many of the blade trailing ends were modified so that a three-period sinusoidal relationship existed as shown in Table II below.

TABLE II

| Blade No. | Radial Depth (in.) | Blade No. | Radial Depth (in.) |
|---|---|---|---|
| 1 | 0.50 | 12 | 0.0 |
| 2 | 0.40 | 13 | 0.19 |
| 3 | 0.19 | 14 | 0.40 |
| 4 | 0.0 | 15 | 0.50 |
| 5 | 0.0 | 16 | 0.40 |
| 6 | 0.19 | 17 | 0.19 |
| 7 | 0.40 | 18 | 0.0 |
| 8 | 0.50 | 19 | 0.0 |
| 9 | 0.40 | 20 | 0.19 |
| 10 | 0.19 | 21 | 0.40 |
| 11 | 0.0 | | |

Figure 13:
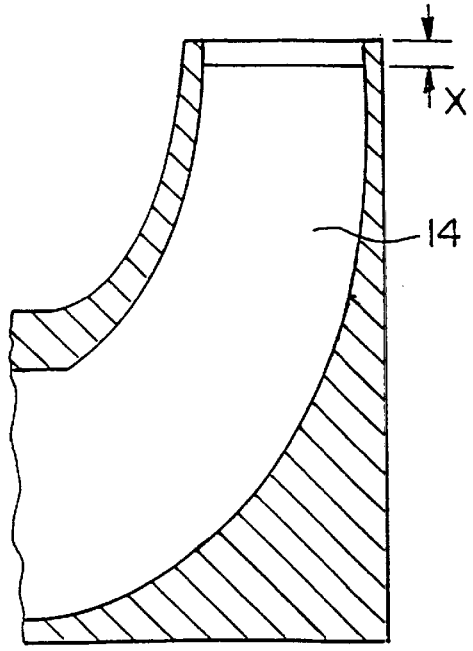
FIG. 13 is a side elevational view of a portion of the disc shown in FIG. 12.

As shown in FIGS. 12 and 13, the radial cut back "x" varies for the twenty-one blades in a sinusoidal relationship between zero and 0.50 inches. Prior to the above modification, this twenty-one bladed disc was the bladed disc which created the graphs which are FIGS. 9 and 10.

Figure 14:
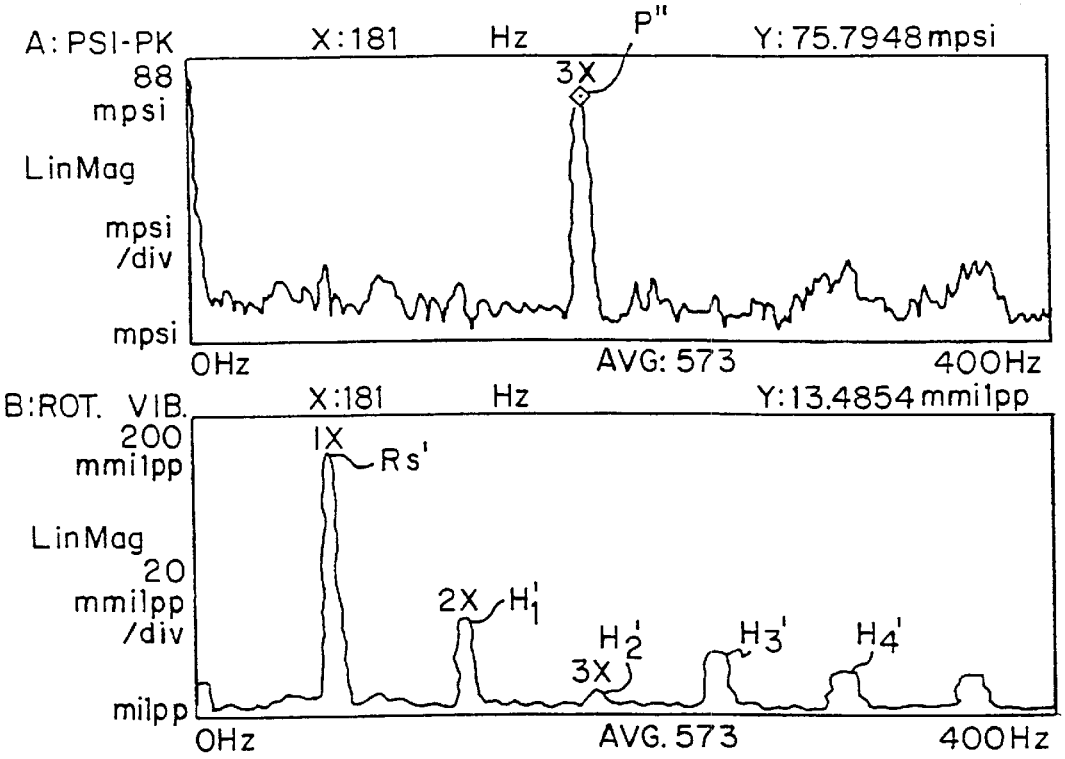
FIG. 14 is a comparison of two graphs where no one-cell rotating stall is present in a rotating disc.

Subsequent to the modification, the impeller was replaced into the compressor housing. A flow/pressure curve was run again to determine if a one-cell condition still existed. Based upon the dynamic probe and the eddy current radial vibration sensor information, the one-cell rotating stall condition was overcome, as shown by the graphs in FIG. 14. As shown by the graphs, point "P'" has a frequency of three times the rotating speed "RS'". Harmonics "$H_1$'", "$H_2$'", "$H_3$'" and "$H_4$'" are still present. In other words, the stall was forced to stay within the impeller until surge was reached. No significant response was found for frequencies below the running speed, such as occurred in FIGS. 9 and 10 at frequency "P".

Figure 15:
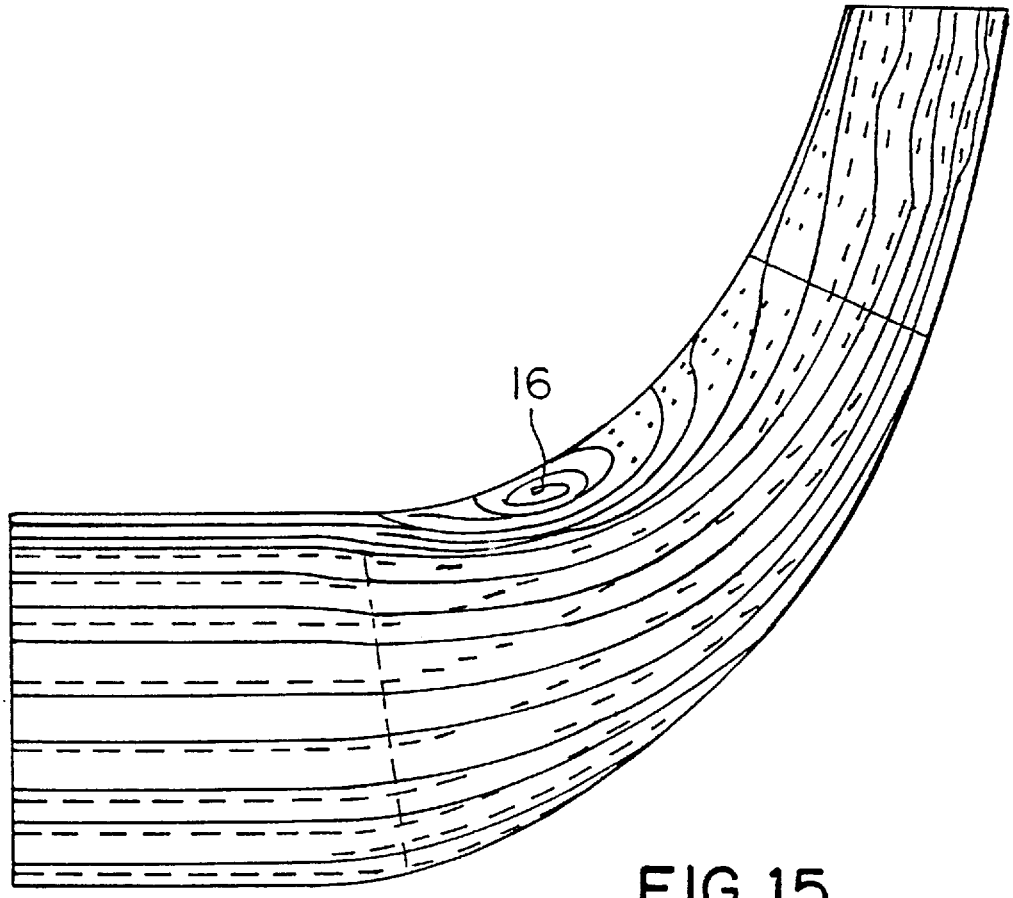
FIG. 15 shows an impeller modeled by CFD analysis showing a stalled flow.

An alternative method to identify stall is to mathematically model the compressor and bladed disc using aerodynamic techniques to determine where stall will occur. Such mathematical modeling techniques are known as computational fluid dynamic (CFD) programs, such as "TASCflow" provided by Advanced Scientific Computing, 554 Parkside Drive, Waterloo, Ontario, Canada; "FLOTRAN®" by Ansys, Inc., 201 Johnson Road, Houston, Pa., United States of America; and "DAWES CODE" provided by Lynx Vale Ltd., 20 Trumpington Street, Cambridge, England. The exact dimensions of each of the blades (by C.M.M. measurements or from drawing tolerances) must first be obtained and the sections of the bladed disc are modeled by the appropriate computer CFD program along with the other parts for determining where stall will occur for particular flow rates, such as shown in FIG. 15. Using this information, one can determine if stalling will first occur in the bladed disc, where stall will occur, and whether a one-cell stall pattern will occur and which blades of the bladed disc are responsible for the one-cell stall. The blades can then be modified to overcome the one-cell stall pattern.

Once it is determined that a one-cell stall condition exists, which is initiated by a bladed disc having a plurality of blades, the blades can be modified to compensate for the one-cell stall. More particularly, a multiple stall condition is forced upon the bladed disc so as to create a balanced dynamic load.

Although forcing stall conditions onto a bladed disc may affect the performance curve of compressors, it is believed that the effect on the compressors can be negligible.

Having described the presently preferred embodiments of the invention, it is to be understood that it may otherwise be embodied within the scope of the appended claims.

I claim:

1. A method for preventing one-cell rotating stall initiated by a bladed disc having a plurality of blades, comprising the steps of:

identifying a one-cell stall condition; and modifying one or more blades to force said bladed disc into at least a two-cell stall pattern.

2. A method for preventing one-cell rotating stall initiated by a bladed disc as claimed in claim 1, wherein spacing between the blades is modified to force said bladed disc into at least a two-cell stall pattern.

3. A method for preventing one-cell rotating stall initiated by a bladed disc as claimed in claim 1, wherein at least one blade is geometrically modified so as to force the bladed disc into at least a two-cell stall pattern.

4. A method for preventing one-cell rotating stall initiated by a bladed disc as claimed in claim 1, wherein a plurality of blades are modified in a sinusoidal relationship.

5. A method for preventing one-cell rotating stall initiated by a bladed disc as claimed in claim 1, wherein the one-cell stall is identified through computational fluid dynamic techniques.

6. A method for preventing one-cell rotating stall initiated by a bladed disc as claimed in claim 1, wherein pressure probes are used to identify the presence of a one-cell stall.

7. A method for preventing one-cell rotating stall initiated by a bladed disc as claimed in claim 6, wherein said pressure probes are to identify the location of the one-cell pressure stall.

8. A method for preventing one-cell rotating stall initiated by a bladed disc as claimed in claim 1, wherein an eddy current radial vibration sensor is used to identify the presence of a one-cell stall.

* * * * *